US007715767B2

(12) United States Patent
Yoshioka

(10) Patent No.: US 7,715,767 B2
(45) Date of Patent: May 11, 2010

(54) IMAGE FORMING APPARATUS WITH EXTENDED IMAGE CARRIER LIFE

(75) Inventor: Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 643 days.

(21) Appl. No.: 11/635,648

(22) Filed: Dec. 8, 2006

(65) Prior Publication Data

US 2007/0292170 A1 Dec. 20, 2007

(30) Foreign Application Priority Data

Jun. 19, 2006 (JP) ..... P2006-169202

(51) Int. Cl.
*G03G 15/01* (2006.01)

(52) U.S. Cl. ..... 399/299

(58) Field of Classification Search ..... 399/66, 399/298, 299, 302, 306, 308
See application file for complete search history.

(56) References Cited

U.S. PATENT DOCUMENTS 6,198,899 B1 * 3/2001 Takahashi et al. ..... 399/303
6,470,166 B2 * 10/2002 Mizoguchi et al. ..... 399/302
6,738,594 B2 * 5/2004 Nakagawa et al. ..... 399/299
6,934,497 B2 8/2005 Hagiwara et al. ..... 399/299
7,164,877 B2 * 1/2007 Murakami et al. ..... 399/121
2004/0202488 A1 10/2004 Tamaki et al.
2006/0251450 A1 * 11/2006 Murayama et al. ..... 399/299

FOREIGN PATENT DOCUMENTS

CN 1517815 A 8/2004
JP 2002091128 A * 3/2002
JP 2002189330 A * 7/2002
JP 2004078128 A * 3/2004
JP A-2004-078128 3/2004

* cited by examiner

*Primary Examiner*—Robert Beatty
(74) *Attorney, Agent, or Firm*—Morgan, Lewis & Bockius LLP

(57) ABSTRACT

An image forming apparatus includes: plural image carriers that are disposed at intervals and in a line, and that are driven to rotate while carrying images; an intermediate transfer belt that have an endless shape, and that is disposed to be laid on plural rolls so as to be able to contact the image carriers; plural transfer rolls that rotate while being brought into contact with the image carriers through the intermediate transfer belt in a first position, respectively, so as to transfer the images on the image carriers to the intermediate transfer belt; and a moving mechanism that moves a part of the plural transfer rolls to a second position keeping apart from the plural image carriers while the part of the plural transfer rolls are kept in contact with the intermediate transfer belt.

6 Claims, 12 Drawing Sheets

FIG. 4

| MODE | PROCESS SPEED (mm/sec) | | | | |
|---|---|---|---|---|---|
| | INTERMEDIATE TRANSFER BELT | PHOTOCONDUCTOR DRUM | | | |
| | | BLACK | MAGENTA | CYAN | YELLOW |
| MONOCHROME | 194 | 194 | 52 | 52 | 52 |
| FULL COLOR | 104 | 104 | 104 | 104 | 104 |

IMAGE FORMING APPARATUS WITH EXTENDED IMAGE CARRIER LIFE

BACKGROUND

1. Technical Field

The present invention relates to printers, copying machines and other image forming apparatuses using an intermediate transfer system.

2. Related Art

In recent years, for example, the following apparatus using an intermediate transfer system has been known as an image forming apparatus such as a printer using an electrophotographic system or an electrostatically recording system.

That is, in such an image forming apparatus, as shown in FIG. 13 by way of example, four image forming units 10Y, 100M, 100C and 100K for forming toner images of four colors, yellow (Y), magenta (M), cyan (C) and black (K) dedicatedly on image carriers 101 such as photoconductor drums are disposed in series. Toner images of yellow, magenta, cyan and black formed by the image forming units 100 (Y, M, C and K) respectively are temporarily (primarily) transferred to an endless intermediate transfer belt 201 which is rotating. The intermediate transfer belt 201 is disposed to be able to contact the image carriers 101 of the image forming units individually. Due to the rotation of the intermediate transfer belt 201, the toner images are conveyed to a secondary transfer position where a recording sheet 300 runs together. Then, the toner images are (secondarily) transferred to the recording sheet 300 in a lump, and fixed thereon. The reference numerals 150 in FIG. 13 represent primary transfer rolls for rotating the intermediate transfer belt 201 so as to press it against the image carriers 101 respectively, and transfer the images on the image carriers 101 to the intermediate transfer belt 201 respectively. The reference numerals 202-204 represent plural support rolls for stretching the intermediate transfer belt 201 so as to rotate and drive it.

According to this image forming apparatus, a full color (multi-color) image having a configuration where the aforementioned toner images of the four colors have been combined, or a single-color image such as a monochrome image composed of toner images of one or two colors of the aforementioned four colors is formed.

Of such image forming apparatuses, for example, there is an apparatus designed to operate at least a part of image carriers (for example, 101Y, 101M and 101C) of the plural image carriers 101 (Y, M, C and K) so that the rotation velocities thereof are changed over to velocities different from the rotation velocities of the other image carriers (for example, 101K) and the rotation velocity of the intermediate transfer belt 201. Thus, it is possible to obtain an image forming operation satisfying proper image forming conditions corresponding to a difference in kind of image to be formed (for example, a difference between a color image and a single-color image), a difference in kind of recording sheet or the like.

In a special example of the image forming apparatus, a color image forming mode and a monochrome image forming mode are prepared. When the monochrome image forming mode is selected, the rotation velocity of the image carrier 101K of the image forming unit 100K engaged in operation for forming a monochrome image is set to be equal to the rotation velocity of the intermediate transfer belt 201. On the other hand, the rotation velocities of the image carriers 101Y, 101M and 101C in the other image forming units 100Y, 100M and 100C which are not engaged in the operation for forming a monochrome image are changed over to be set to be lower than the rotation velocity of the image carrier 101K or the rotation velocity of the intermediate transfer belt 201. A monochrome image may be formed by operating (activating) the image forming apparatus in such changed conditions. When a monochrome image is formed in such conditions, the image carriers 101Y, 101M and 101C in the image forming units which are not engaged in the operation for forming the monochrome image can be prevented from being driven to rotate needlessly. Thus, the lives of the image carriers 101Y, 101M and 101C can be prevented from being shortened.

SUMMARY

According to a first aspect of the present invention, an image forming apparatus includes: plural image carriers that are disposed at intervals and in a line, and that are driven to rotate while carrying images; an intermediate transfer belt that have an endless shape, and that is disposed to be laid on plural rolls so as to be able to contact the image carriers; plural transfer rolls that rotate while being brought into contact with the image carriers through the intermediate transfer belt in a first position, respectively, so as to transfer the images on the image carriers to the intermediate transfer belt; and a moving mechanism that moves a part of the plural transfer rolls to a second position keeping apart from the plural image carriers while the part of the plural transfer rolls are kept in contact with the intermediate transfer belt.

BRIEF DESCRIPTION OF THE DRAWINGS

Exemplary embodiment of the present invention will be described in detail based on the following figures, wherein:

FIG. 4 is a table showing setting conditions of process speeds in each mode;

DETAILED DESCRIPTION

Figure 1:
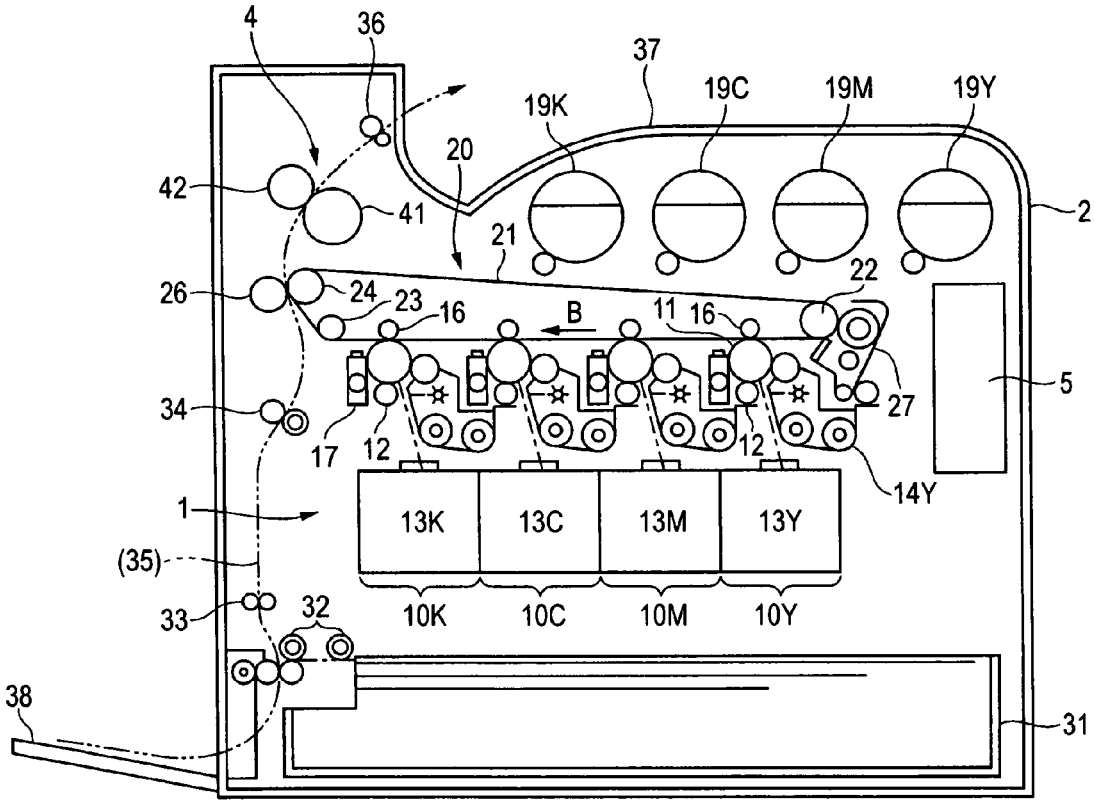
FIG. 1 is a schematic explanatory view showing the whole of an image forming apparatus according to a first exemplary embodiment.
Figure 2:
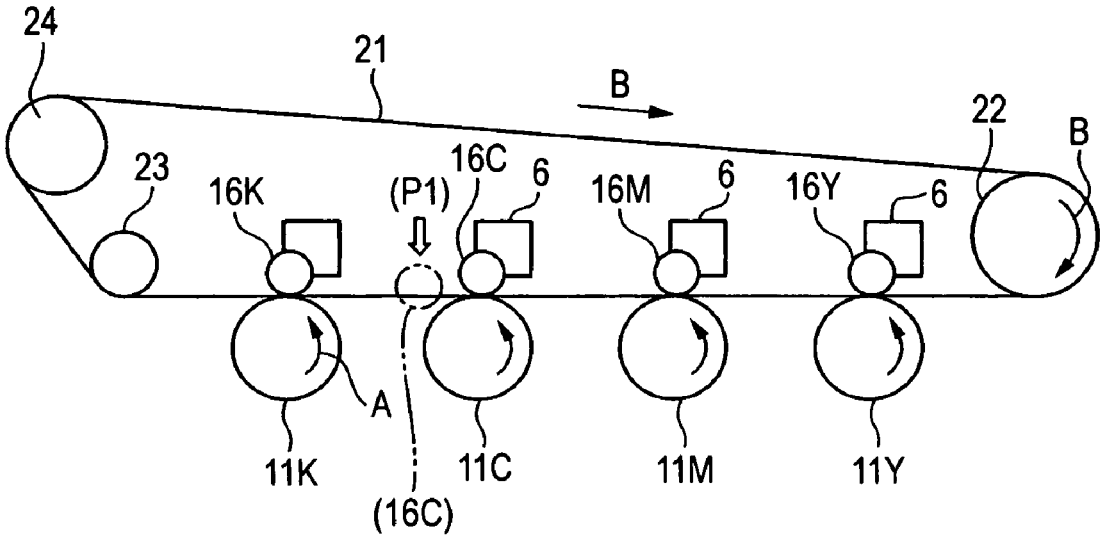
FIG. 2 is a schematic explanatory view showing a main portion (a primary transfer portion, a moving mechanism, etc.) of the image forming apparatus in FIG. 1.

FIGS. 1 and 2 show an image forming apparatus according to a first exemplary embodiment of the invention. FIG. 1 shows the outline of the apparatus as a whole, and FIG. 2 shows a main portion of the apparatus.

This image forming apparatus is, for example, designed as a color printer. An image forming device 1 for forming toner images in accordance with image information and then transferring the toner images to a recording sheet is formed inside an apparatus body 2 of the image forming apparatus. The image forming device 1 is constituted by four image forming units 10Y, 10M, 10C and 10K and an intermediate transfer unit 20. The image forming units 10Y, 10M, 10C and 10K form toner images of four colors, that is, yellow (Y), magenta (M), cyan (C) and black (K) dedicatedly. The intermediate transfer unit 20 transfers each color toner image formed by each image forming unit 10 (Y, M, C, K) to an intermediate transfer belt 21 temporarily, and conveys the toner image to a secondary transfer position where the toner image will be transferred to a recording sheet 9 such as given paper. A paper feed unit 3, a fixing unit 4, a system control unit 5, etc. are also disposed inside the apparatus body 2. The paper feed unit 3 feeds the recording sheet 9 to the secondary transfer position in the intermediate transfer unit 20 of the image forming device 1. The fixing unit 4 fixes the toner images transferred in the secondary transfer position, onto the recording sheet 9. The system control unit 5 controls each operation involved in the printer as a whole including these units or other units.

Each image forming unit 10 (Y, M, C, K) has a cylindrical photoconductor drum 11 which is driven to rotate in the direction of the arrow A as shown in FIG. 1 or 2. A charging unit 12 of a charging roll system, an exposure unit 13, a developing unit 14, a primary transfer unit 16 of a transfer roll system, a drum cleaning unit 17, etc. are chiefly disposed around the photoconductor drum 11. The charging unit 12 charges the surface of the photoconductor drum 11 uniformly. The exposure unit 13 is constituted by a laser scanner or the like for irradiating the charged surface of the photoconductor drum 11 with image light (broken line) based on image information (signal) so as to form an electrostatic latent image having a potential difference and corresponding to each color component. The developing unit 14 transfers and attaches a developing agent (toner component) of one of the aforementioned colors corresponding to the electrostatic latent image so as to form a single-color toner image in the corresponding one of the aforementioned four colors. The primary transfer unit 16 transfers the formed toner image to the intermediate transfer belt 21. The drum cleaning unit 17 cleans the surface of the photoconductor drum 11 after the primary transfer.

Of these parts, a charger used as the charging unit 12 is of a contact charging system by which a charging roll applied with a charging bias is brought into contact with the photoconductor drum 11 so as to be charged. A not-shown image processing unit installed in the apparatus body 2 performs predetermined image processing (for each color component) upon image information transmitted from a not-shown externally connected device such as an image reader or a personal computer. An image signal obtained thus is supplied to the exposure unit 13. Toner of a predetermined color is supplied to each developing unit 14 (Y, M, C, K) from a toner cartridge 19 (Y, M, C, K). A roll-system transferor in which a primary transfer roll applied with a primary transfer bias is pressed onto an intermediate transfer belt 21 from its inner circumferential surface side toward the photoconductor drum 11 so as to perform transferring is used as the primary transfer unit 16.

The intermediate transfer unit 20 rotates the intermediate transfer belt 21 in the direction of the arrow B while stretching the intermediate transfer belt 21 over plural rolls 22-24 so as to pass through a primary transfer position between the photoconductor drum 11 and the primary transfer unit 16 of each image forming unit 10 (Y, M, C, K). The intermediate transfer belt 21 is constituted by an endless belt made of a resin film prepared to have a predetermined volume resistivity due to a conductive agent contained therein. The roll 22 is a driving roll. The roll 23 is a tension roll for giving a constant tension to the intermediate transfer belt 21. The roll 24 is a secondary transfer backup roll. In addition, a secondary transfer roll 26 is disposed on the intermediate transfer belt 21 supported by the secondary transfer backup roll. The reference numeral 27 in FIG. 1 represents a belt cleaning unit for cleaning the intermediate transfer belt 21 after the secondary transfer.

The paper feed unit 3 has a paper feed cassette 31, a feeder 32, and a sheet conveyance path 35. The paper feed cassette 31 receives recording sheets 9. The feeder 32 sends out the recording sheets 9 from the paper feed cassette 31 one by one. The sheet conveyance path 35 is constituted by plural-conveyance rolls 33, guide members, etc. The conveyance rolls 33 convey the recording sheets 9 sent out from the feeder 32. A manual paper feed tray 38 is also provided in the apparatus body 2. The recording sheets 9 on which images will be formed can be also supplied from the manual paper feed tray 38.

The fixing unit 4 is chiefly constituted by a heating roll 41 to be driven to rotate, and a pressure roll 42. The heating roll 41 has a heating source. The pressure roll 42 rotates while having pressure contact to the heating roll 41 with a predetermined pressure. A recording sheet 9 to be applied to fixation is introduced into a pressure contact portion between the heating roll 41 and the pressure roll 42, and passed through the pressure contact portion. Thus, fixation is performed on the recording sheet 9. In addition, a discharge roll 36 is provided so that, as a conveyance path of the recording sheet, the recording sheet 9 applied to fixation and passing through the fixing unit 4 is discharged by the discharge roll 36 to a discharge reception portion 37 formed in the exterior of the apparatus body 2.

Figure 3:
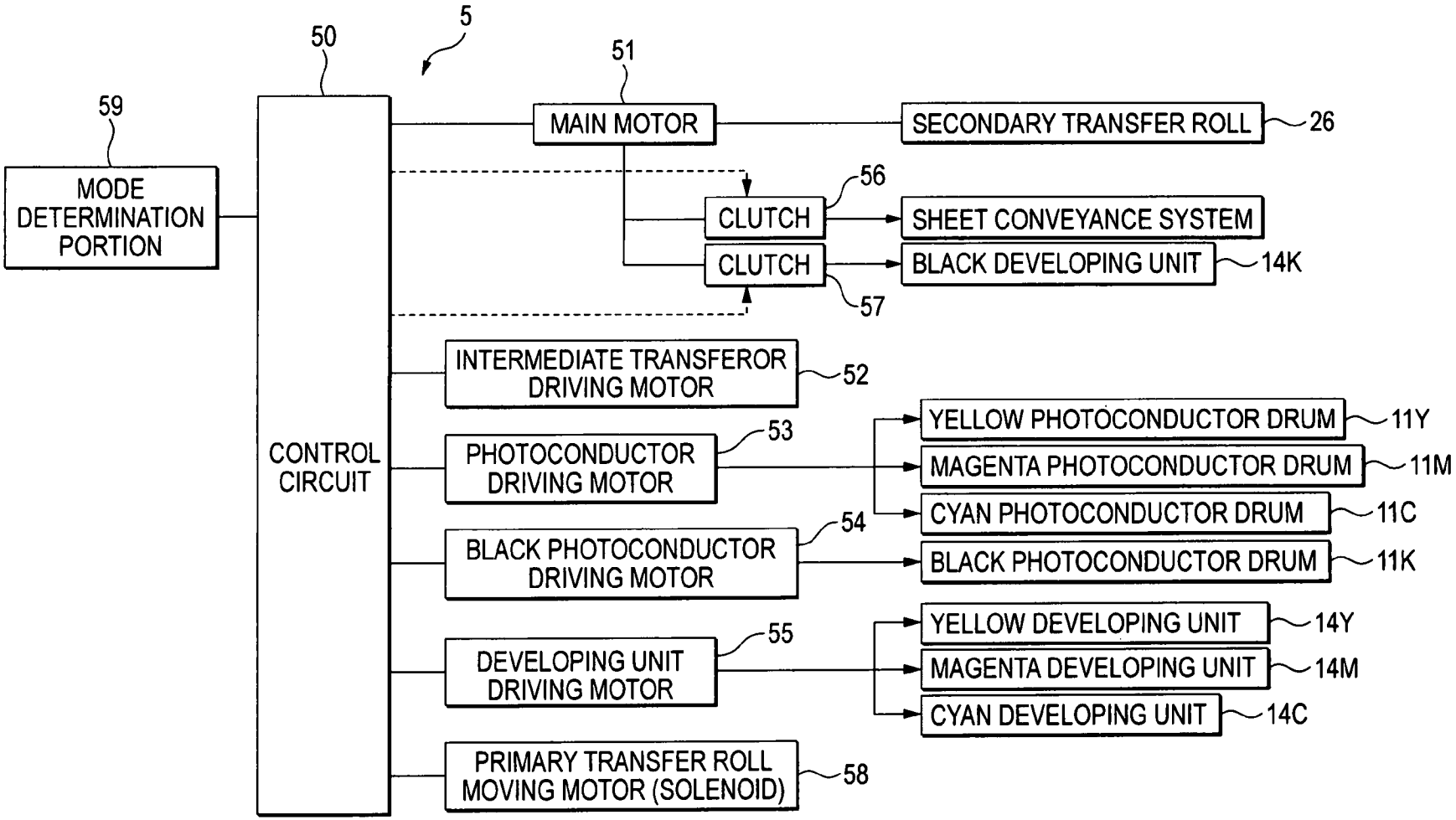
FIG. 3 is a block diagram showing a main portion (chiefly a control portion connected with a driving system) of a control unit.

The control unit 5 has a control portion connected with a driving system as shown in FIG. 3. This control unit 5 has a control circuit 50 constituted by a central processing unit, a memory, a storage, etc. The control circuit 50 controls operations of constituent parts of the driving system according to a control program stored in the storage.

The control circuit 50 in this example controls a main motor 51 for driving the fixing unit 4, a sheet conveyance system including the paper feed unit 3 and the sheet conveyance path, the black developing unit 14K, etc., an intermediate-transferor driving motor 52 for driving the intermediate transfer belt 21 of the intermediate transfer unit 20, etc., a color photoconductor driving motor 53 for driving the photoconductor drums 11Y, 11M and 11C in the color image forming units 10Y, 10M and 10C excluding the black image forming unit 10K, a black photoconductor driving motor 54 for driving the photoconductor drum 11K in the black image forming unit 11K, a color developing unit driving motor 55 for driving the color developing units 14Y, 14M and 14C, etc. individually. The control circuit 50 also controls a clutch 56 which is connected to the main motor 51 so as to change over the driving of the sheet conveyance system, and a clutch 57 which is connected to the main motor 51 so as to change over the driving of the black developing unit 14K. Further, the control circuit 50 controls a primary transfer roll moving motor 58 for driving a primary transfer roll moving unit (6) which will be described later. That is, the operations of the aforementioned kinds of motors and clutches are controlled by the control circuit 50 so as to adjust the operation timing of each part of the printer. Thus, an image forming operation is implemented.

In this printer, a mode (full color mode) to form a full color image composed of toner images of the aforementioned four colors (Y, M, C and K) and a mode (monochrome mode) to form a monochrome image composed of only a toner image of black (K) can be selected. An image forming (printing) operation can be carried out in accordance with a selected one of the modes.

This mode selection is performed by inputting selection information into printer command information or image information inputted or transmitted from an external device such as a personal computer connected to the printer, or by performing a selection operation on an operation panel provided in the apparatus body 2 of the printer. This selection information of the mode is supplied to the control circuit 50 of the control unit 5 through a mode determination portion 59 in the image processing unit or the like as shown in FIG. 3.

When the full color mode or the monochrome mode is selected, settings are done so that the intermediate transfer belt 21 and the fourth photoconductor drums 11 (Y, M, C and K) are driven at rotation velocities (process speeds) respectively in accordance with the selected mode as shown in FIG. 4. That is, in the full color mode, settings are done so that the intermediate transfer belt 21 and the four photoconductor drums 11 are driven to rotate at the same velocity (e.g. 104 mm/sec) as each other. In the monochrome mode, settings are done so that the intermediate transfer belt 21 and the black photoconductor drum 11K are driven to rotate at the same high velocity (e.g. 194 mm/sec) as each other, while the color photoconductor drums 11 (Y, M and C) are driven to rotate at a low velocity (e.g. 52 mm/sec).

In this printer, when the monochrome mode is selected, the rotation velocities of the intermediate transfer belt 21 and the four photoconductor drums 11 are set as described above. In addition thereto, a moving mechanism 6 is provided. The primary transfer rolls 16 (Y, M and C) opposed to the photoconductor drums 11 (Y, M and C) in the color image forming units (Y, M and C) which are not engaged in the formation of a black toner image are moved to predetermined positions by the moving mechanism 6.

Figure 5:
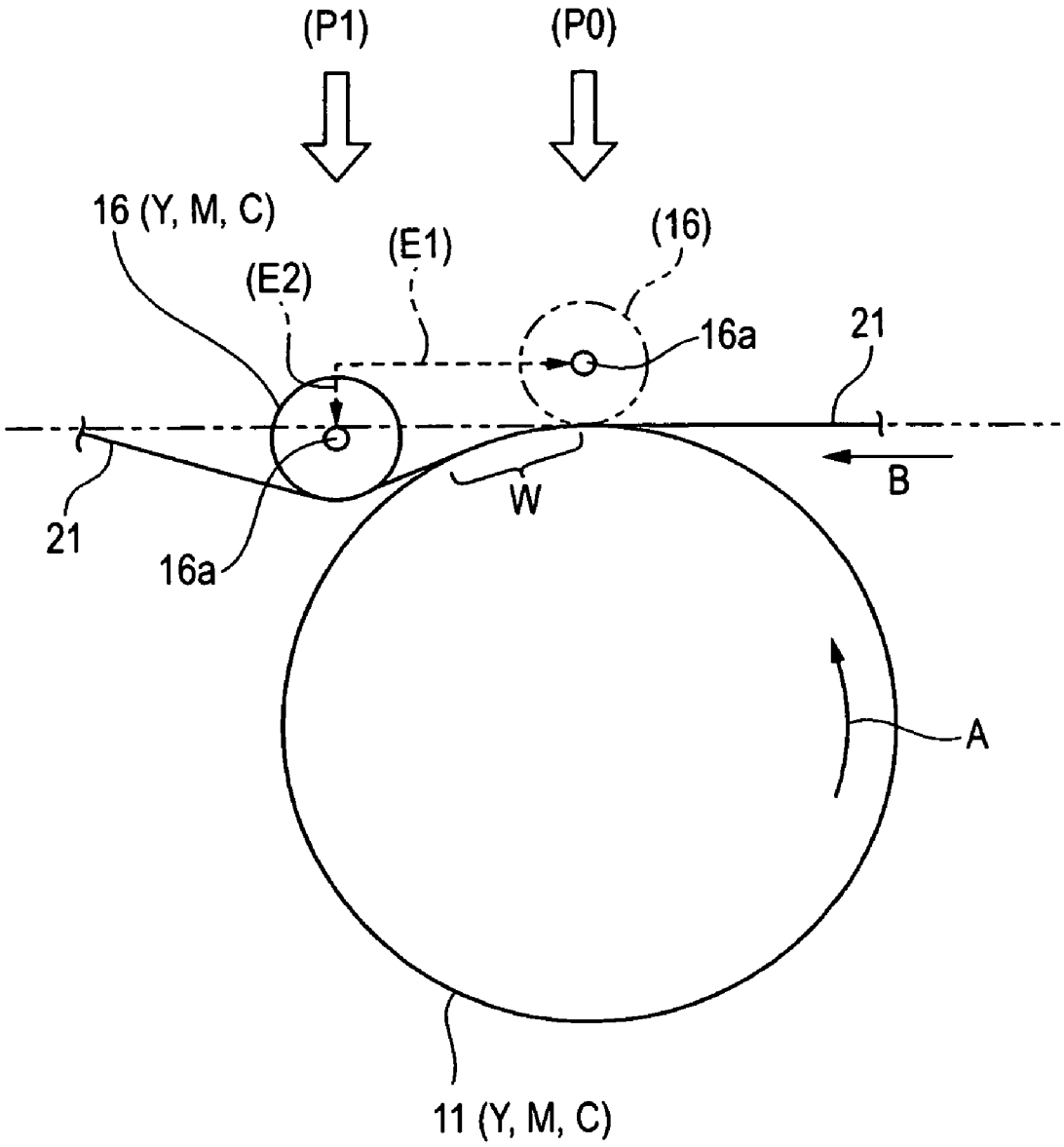
FIG. 5 is a schematic explanatory view showing the moving mechanism for moving each intended primary transfer roll in a monochrome mode, and a state of movement thereof.

As shown in FIG. 5, the moving mechanism 6 moves the primary transfer roll 16 (Y, M, C) from a transfer position (P0) to a first position (P1). In the transfer position (P0), the primary transfer roll 16 (Y, M, C) is in contact with the photoconductor drum 11 (Y, M, C) through the intermediate transfer belt 21. In the first position (P1), the primary transfer roll 16 (Y, M, C) is kept away from the photoconductor drum 11 (Y, M, C) while the intermediate transfer belt 21 is kept in contact with both the primary transfer roll 16 (Y, M, C) leaving the photoconductor drum 11 (Y, M, C) and the photoconductor drum 11 (Y, M, C) and swells toward the outer circumferential surface of the belt so as to make a detour. The straight line expressed by the two-dot chain line in FIG. 5 designates the (virtual) state of the intermediate transfer belt 21 when the primary transfer roll 16 (Y, M, C) is in the transfer position (P0). This line substantially corresponds to a tangent in the transfer position (P0) of the photoconductor drum 11 on the primary transfer roll 16 (Y, M, C).

In this case, the moving mechanism 6 is attached so that a rotation shaft 16*a* of the primary transfer roll 16 (Y, M, C) or a support frame thereof can be slid on a guide member (guide rail or the like) for guiding the rotation shaft 16*a* or the support frame thereof from the transfer position P0 to the first position P1. The rotation shaft 16*a* or the support frame thereof is used directly or through suitable conversion (including power conversion using a cam) as driving force for moving the rotating power of the primary transfer roll moving motor 58 or the linear power of a solenoid, so as to move the rotation shaft 16*a* or the support frame thereof to both the positions (P0 and P1).

This example uses a configuration in which the moving mechanism 6 moves between the transfer position P0 and the first position P1 through two moving steps (first moving step E1 and a second moving step E2) as shown by the broken-like two-way arrow in FIG. 5. The first moving step E1 corresponds to a step of moving in a process direction (direction such as a belt moving direction B). The second moving step E2 corresponds to a step of moving in a downward direction substantially perpendicular to the direction of the first moving step. The first position P1 can be located in a position on the opposite side to the process direction in view from the transfer position P0. However, in the case where the first position P1 is located in such a position, there is a fear that the intermediate transfer belt 21 may crease when the primary transfer roll 16 moves to the opposite side to the process direction, or deflection (very small deformation) may occur in the intermediate transfer belt 21 due to creases generated unevenly in a direction crossing the process direction. It is therefore preferable that the first position P1 is located on the same side as the process direction.

Next, description will be made on a fundamental image forming (printing) operation using the printer configured thus.

Figure 6:
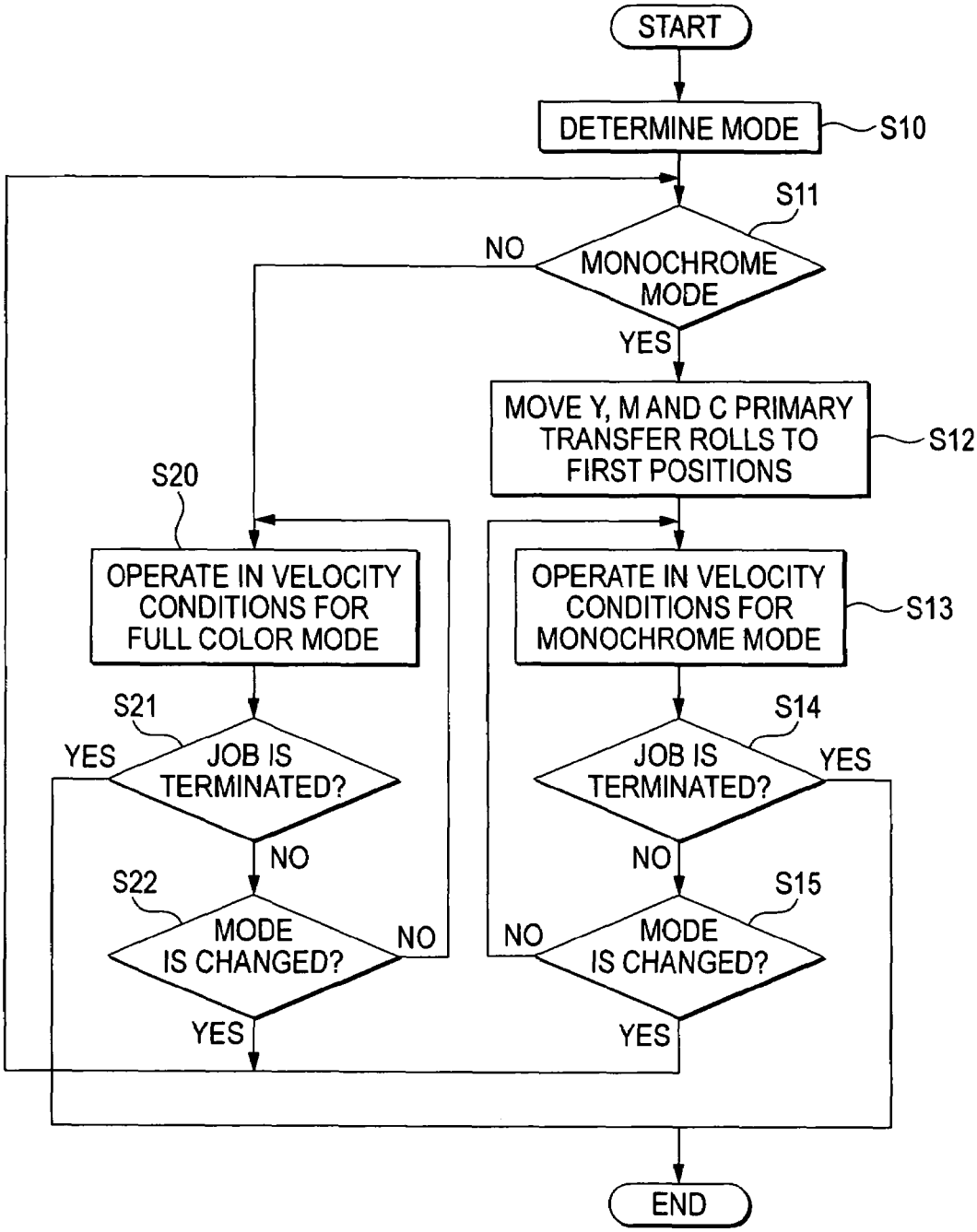
FIG. 6A flow chart showing main control operations in an image forming operation (printing) by the image forming apparatus in FIG. 1.

When the control unit 5 receives a print command inputted or transmitted from a not-shown operation panel or an external device such as a personal computer connected to the printer, the control unit 5 first determines whether the print command designates the full color mode or the monochrome mode as shown in FIG. 6 (Steps S10 and S11). Here, first, description will be made on the assumption that the received print command designates the full color mode.

In this case, it is concluded in Step S11 that the monochrome mode is not selected (Step S11). After that, the printer is operated with the intermediate transfer belt 21 and the four photoconductor drums 11 (Y, M, C and K) being driven to rotate in the velocity conditions (FIG. 4) in the full color mode (Step S20). In this example, all the intermediate transfer belt 21 and the four photoconductor drums 11 (Y, M, C and K) are driven to rotate at a rotation velocity of "104 mm/sec".

In the full color mode, toner images of the aforementioned four colors are first formed respectively in the image forming units 10 (Y, M, C and K) of the image forming device 1, and then transferred to the intermediate transfer unit 20.

That is, in each image forming unit 10, the photoconductor drum 11 staring rotating is charged to a predetermined potential by the charging unit 12. The charged photoconductor drum 11 is scanned and exposed to light in accordance with an image signal by the exposure unit 13. Thus, an electrostatic latent image corresponding to a corresponding color component is formed. After that, the electrostatic latent image is developed with corresponding color toner in the developing unit 14. Thus, toner images of the respective colors (Y, M, C and K) are formed. The toner images formed in the image forming units 10 respectively are electrostatically transferred to the intermediate transfer belt 21 in the intermediate transfer unit 20 of the image forming device 1 in the primary transfer positions where the photoconductor drums 11 are opposed to the primary transfer units 16. Thus, the toner images are transferred sequentially so as to be superimposed on one another. After that, the intermediate transfer belt 21 is conveyed to the secondary transfer position where the intermediate transfer belt 21 is opposed to the secondary transfer roll 26. The primary transfer is performed by a transfer electric field formed between the intermediate transfer belt 21 and the photoconductor drum 11 by transfer bias having polarity opposite to the toner charge polarity and applied to the primary transfer roll of the primary transfer unit 16.

On the other hand, recording sheets 9 required by the aforementioned print command are sent out one by one from the paper feed cassette 31, where the paper feed unit 3 is received, by the feeder 32. Each sent-out recording sheet 9 is conveyed in the sheet conveyance path 35 by the plural conveyance rolls 33 and so on. The recording sheet 9 is then sent and supplied into the secondary transfer position at predetermined timing by a registration roll 34. In the secondary transfer position, the toner images transferred onto the intermediate transfer belt 21 are electrostatically transferred onto the supplied recording sheet 9 in a lump. The secondary transfer is, for example, performed in a transfer electric field formed between the recording sheet 9 and the secondary transfer roll 26 through the intermediate transfer belt 21 by transfer bias having the same polarity as the toner charge polarity and applied to the secondary transfer backup roll 24.

Successively the recording sheet 9 having the toner images transferred thereto is conveyed toward the fixing unit 4 and introduced into a pressure contact portion between the heating roll 41 and the pressure roll 42. Due to heat and pressure applied to the recording sheet 9 passing through the pressure contact portion, the toner images are fixed onto the recording sheet 9. After the completion of the fixation, the recording sheet 9 is discharged to the discharge reception portion 37 by the discharge roll 36. By the process described above, a full color image composed of toner images of the aforementioned four colors is formed on one recording sheet 9.

Printing in the full color mode as described above is proceeded with till all the print commands (jobs: number of prints) are terminated (Step S21). When the printing is proceeded, it is confirmed whether the mode is changed or not (Step S21). In this event, when the mode is not changed, the next print is executed in the full color mode. When the mode is changed, the routine of processing moves to the step of determining the mode (Step S10).

Figure 7:
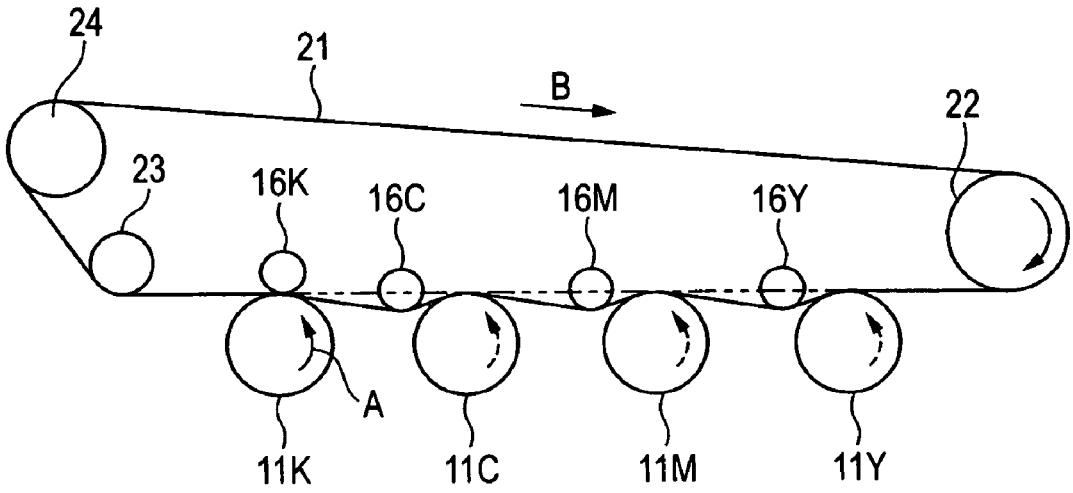
FIG. 7 is a main portion schematic explanatory view showing a state of movement of intended primary transfer rolls in the monochrome mode.

On the other hand, when it is concluded in Step S11 that the print command designates the monochrome mode, the moving mechanism 6 is operated to move the primary transfer rolls 16 (Y, M and C) of the color image forming units 10 (Y, M and C) excluding the black image forming unit 10K from their transfer positions P0 to their first positions P1 respectively (Step S12). As a result, the primary transfer rolls 16 (Y, M and C) are moved to the first positions P1 with respect to the photoconductor drums 11 (Y, M and C) respectively as shown in FIG. 7 (FIG. 5). The two-dot chain line in FIG. 7 (FIG. 5) designates the state of the intermediate transfer belt 21 when the primary transfer rolls 16 (Y, M and C) are located in the transfer positions P0.

This movement of the primary transfer rolls 16 (Y, M and C) is followed by driving the intermediate transfer belt 21 and the four photoconductor drums 11 (Y, M, C and K) so as to rotate the intermediate-transfer belt 21 and the four-photoconductor drums 11 (Y, M, C and K) in the velocity conditions (FIG. 4) in the monochrome mode and thereby operate the printer (Step S13). In this example, as described previously, the intermediate transfer belt 21 and the black photoconductor drum 11K are driven to rotate at the same high rotation velocity of "194 mm/sec". On the other hand, the color photoconductor drums 11 (Y, M and C) are driven to rotate at the low rotation velocity of "52 mm/sec".

In the monochrome mode, first, a black toner image is formed by the black image forming unit 10K of the image forming device 1, and then transferred to the intermediate transfer unit 20. That is, a black toner image is formed on the photoconductor drum 11K of the black image forming unit 10K as described previously. The black toner image is primarily transferred onto the intermediate transfer belt 21 by the primary transfer roll 16K.

In this event, in the color image forming units 10 (Y, M and C), the operation of forming toner images of their corresponding colors (Y, M and C) is not performed, but their corresponding photoconductor drums 11 (Y, M and C) are driven to rotate with a difference in velocity (at a low velocity) with respect to the intermediate transfer belt 21. This is intended to prevent the lowering of the lives of the photoconductor drums 11 (Y, M and C).

In the color image forming units 10 (Y, M and C) at this time, their primary transfer rolls 16 (Y, M and C) move to their first positions P1 respectively (FIGS. 5 and 7) so as to leave the photoconductor drums 11 (Y, M and C). In addition, the intermediate transfer belt 21 is kept in contact with both the primary transfer rolls 16 (Y, M and C) leaving the photoconductor drums 11 (Y, M and C) and the photoconductor drums 11 (Y, M and C) and swelling toward the outer circumferential surface side of the belt so as to be bent.

Thus, the intermediate transfer belt 21 is prevented from moving and running vibrating. As a result, the portion of the intermediate transfer belt 21 where there are particulates or the like adhering thereto can be prevented from vibrating and contacting the photoconductor drums 11 (Y, M and C) with high pressure. In addition, due to the movement of the transfer rolls 16 (Y, M and C), the tension of the intermediate transfer belt 21 increases in accordance with the swelling detour to the outer circumferential surface side of the belt, while the intermediate transfer belt 21 contacts each photoconductor drum 11 (Y, M, C) opposed to its corresponding transfer roll as if it were wrapped around the surface of the photoconductor drum 11 (Y, M, C) (the wrapped belt portion is illustrated by the region designated by the reference sign W in FIG. 5). Thus, the intermediate transfer belt 21 is more surely prevented from moving and running vibrating. As a result, even if a portion to which comparatively hard particulates or the like adhere is present in the outer circumferential surface of the intermediate transfer belt 21, the portion can be prevented from contacting the photoconductor drum 11 (Y, M, C) with pressure increased by the vibrating running. Thus, the drum surface is more hardly scratched.

The black toner image primarily transferred to the intermediate transfer belt 21 is secondarily transferred to a required recording sheet 9 in the secondary transfer position in the same manner as in printing in the full color mode. The black toner image carried on the recording sheet 9 is introduced into the fixing unit 4 as it is, so as to be fixed onto the recording sheet 9. Finally, the recording sheet 9 after the fixation is discharged to the discharge reception portion 37. As a result of the process described above, a monochrome image composed of the black toner image is formed on one recording sheet 9.

Printing in the monochrome mode as described above is proceeded with till all the print commands (jobs: number of prints) are terminated (Step S14). When the printing is proceeded, it is confirmed whether the mode is changed or not (Step S15). In this event, when the mode is not changed, the next print is executed in the monochrome mode. When the mode is changed, the routine of processing moves to the step of determining the mode (Step S10).

(Evaluation Test)

Description will be made below on an evaluation test using the printer according to the first exemplary embodiment.

Particulates (seven kinds of loamy layers of the Kanto Plain: JIS Z8901) are made to adhere to a rotary brush roll. The rotary brush roll is kept to be driven with the rotation of the intermediate transfer belt 21 of the printer, and bring into contact with the outer circumferential surface of the belt 21. A test monochrome image (half tone image) is printed on 400 sheets continuously in the monochrome mode.

In the monochrome mode in this test, the intermediate transfer belt 21 and the black photoconductor drum 11K are driven to rotate at the same high rotation velocity of "208 mm/sec". The color photoconductor drums 11 (Y, M and C) are driven to rotate at the low rotation velocity of "52 mm/sec". Each color primary transfer roll 16 (Y, M, C) is moved to its first position P1 where the length (wrap length W: see FIG. 5) of the portion where the intermediate transfer belt 21 is wrapped around the outer circumferential surface of the photoconductor drum 11 (Example). In this event, a roll whose outer diameter is 30 mm is used as each photoconductor drum 11. For comparison, Comparative Example 1 and Comparative Example 2 were prepared. In Comparative Example 1, each color primary transfer roll 16 (Y, M, C) is placed in its transfer position P0 (in a contact state) where the color primary transfer roll 16 (Y, M, C) is pressed against the corresponding photoconductor drum 11 through the intermediate transfer belt 21. In Comparative Example 2, each color primary transfer roll 16 (Y, M, C) is placed in a position (in a retract state) where the color primary transfer roll 16 (Y, M, C) is at a distance (about 5 mm) from the intermediate transfer belt 21. Printing is performed in Comparative Examples 1 and 2 in the same manner as in Example.

After monochrome printing is performed upon consecutive 400 sheets, depths of scratches present in the surfaces of the color photoconductor drums 11 (Y, M and C) in Example and Comparative Examples are measured and analyzed using a laser microscope individually. The results (average values of maximum depths of scratches present in the three photoconductor drums) are shown in FIG. 8.

Figure 8:
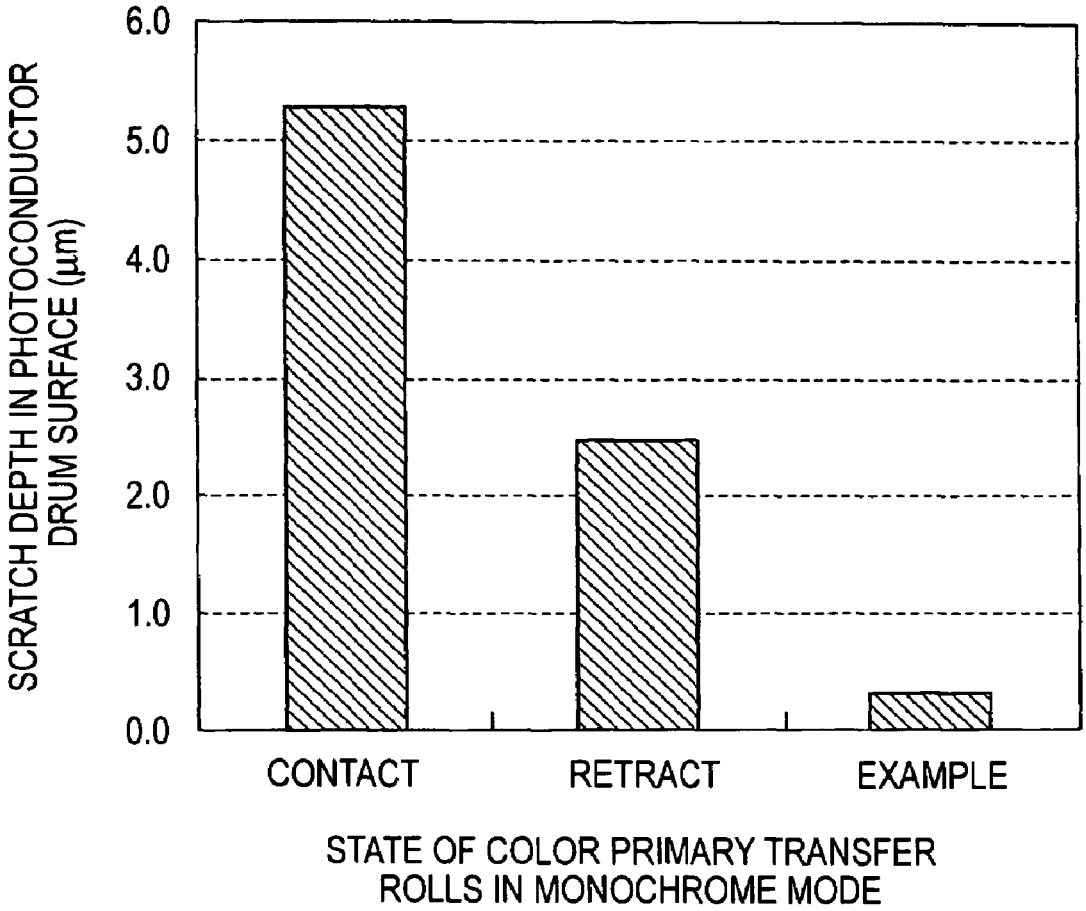
FIG. 8 is a graph showing test results about the condition that depths of scratches appear in photoconductor drum surfaces in Example and Comparative Examples.

As is apparent from the results of FIG. 8, when the color primary transfer rolls 16 (Y, M, C) are moved to their first positions P1 as in this Example, the depths of scratches formed in the surfaces of the color photoconductor drums 11 (Y, M and C) are extremely shallow not only in comparison with those in Comparative Example 1 where the primary transfer rolls 16 (Y, M and C) are brought into a contact state, but also in comparison with those in Comparative Example 2 where the primary transfer rolls 16 (Y, M and C) are brought into a retract state. Assume that the primary transfer rolls 16 (Y, M and C) are brought into a contact state as in Comparative Example 1. In this case, when particulates adhering to the intermediate transfer belt 21 pass through the first transfer portions for color, the surfaces of the color photoconductor drums 11 (Y, M and C) suffer high pressure due to the primary transfer rolls 16 (Y, M and C) pressed thereon respectively. Thus, it is guessed that the surfaces are apt to be scratched, and the depths of the scratches increase. Now assume that the primary transfer rolls 16 (Y, M and C) are brought into a retract state as in Comparative Example 2. In this case, when particulates adhering to the intermediate transfer belt 21 pass through the first transfer portions for color, the surfaces of the color photoconductor drums 11 (Y, M and C) are prevented from suffering high pressure due to the primary transfer rolls 16 (Y, M and C) pressed thereon respectively. However, the surfaces of the color photoconductor drums 11 (Y, M and C) suffer pressure due to contact with the intermediate transfer belt 21 running vibrating. Thus, it is guessed that there occur scratches grown with depth corresponding to the suffered pressure.

Next, single-color halftone images of the colors (Y, M and C) were printed one by one whenever a monochrome halftone image had been printed on consecutive 1,000 sheets in the aforementioned conditions (Example and Comparative Examples 1 and 2). Each print was examined as to whether a failure in image (streaky image formed in the rotation-direction A of each photoconductor drum 11 which was also a process direction) on a level high enough to cause a practical use problem occurred in an image of each color. When it was confirmed that the failure in image occurred, the cumulated number of prints obtained till then was counted, and depths of scratches caused by the aforementioned particulates present in each color photoconductor drum 11 where the failure in image occurred were measured. The results are shown in FIG. 9.

Figure 9:
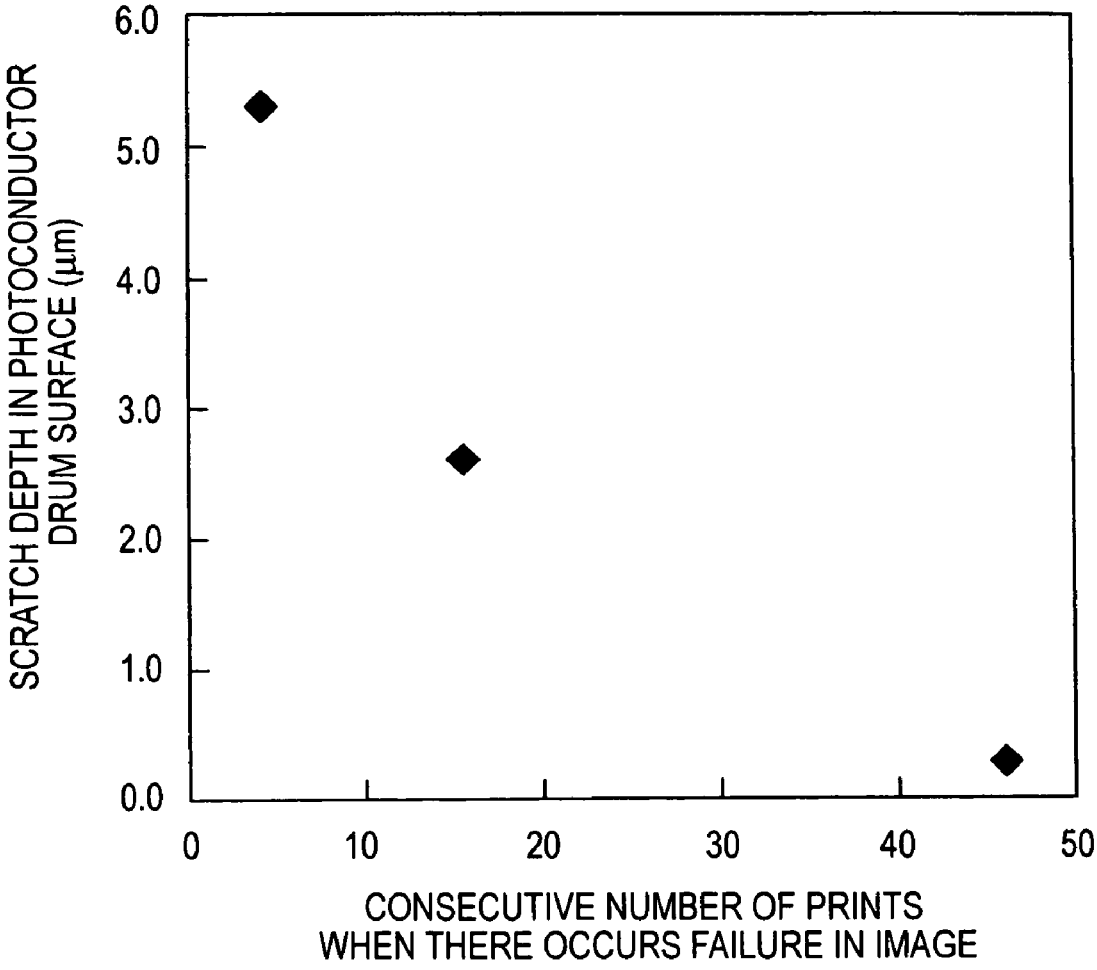
FIG. 9 is a graph showing test results about the relationship between the number of consecutive sheets of prints and the scratch depth in the photoconductor drum surface when there occurs a failure in image.

From the results of FIG. 9, it is understood that when the primary transfer rolls are set in a contact state as in Comparative Example 1, a failure in image occurs in a stage between the time to start printing and the time to reach about 5,000 sheets of prints, and the depths of scratches present in the photoconductor drums 11 at that time reach a relatively deep level. It was also confirmed that when the primary transfer rolls are set in a retract state as in Comparative Example 2, a failure in image can be prevented from occurring till printing on about consecutive 15,000 sheets, and the depths of scratches present in the photoconductor drums 11 at that time become shallower than those in Comparative Example 1. It is understood that when the primary transfer rolls have been moved as in Example of the invention, the state where a failure in image hardly occurs can be kept from the time to start printing to the time to reach 46,000 sheets. It could be also confirmed that the depths of scratches present in the photoconductor drums 11 at that time are extremely shallow if any. In this test, it was confirmed that when there is a deeper scratch in a photoconductor drum, damage caused by toner or the like finally reaches the charging roll surface of the charging unit 12, with the result that a failure in image-is-apt to occur.

Other Embodiments

Figure 10:
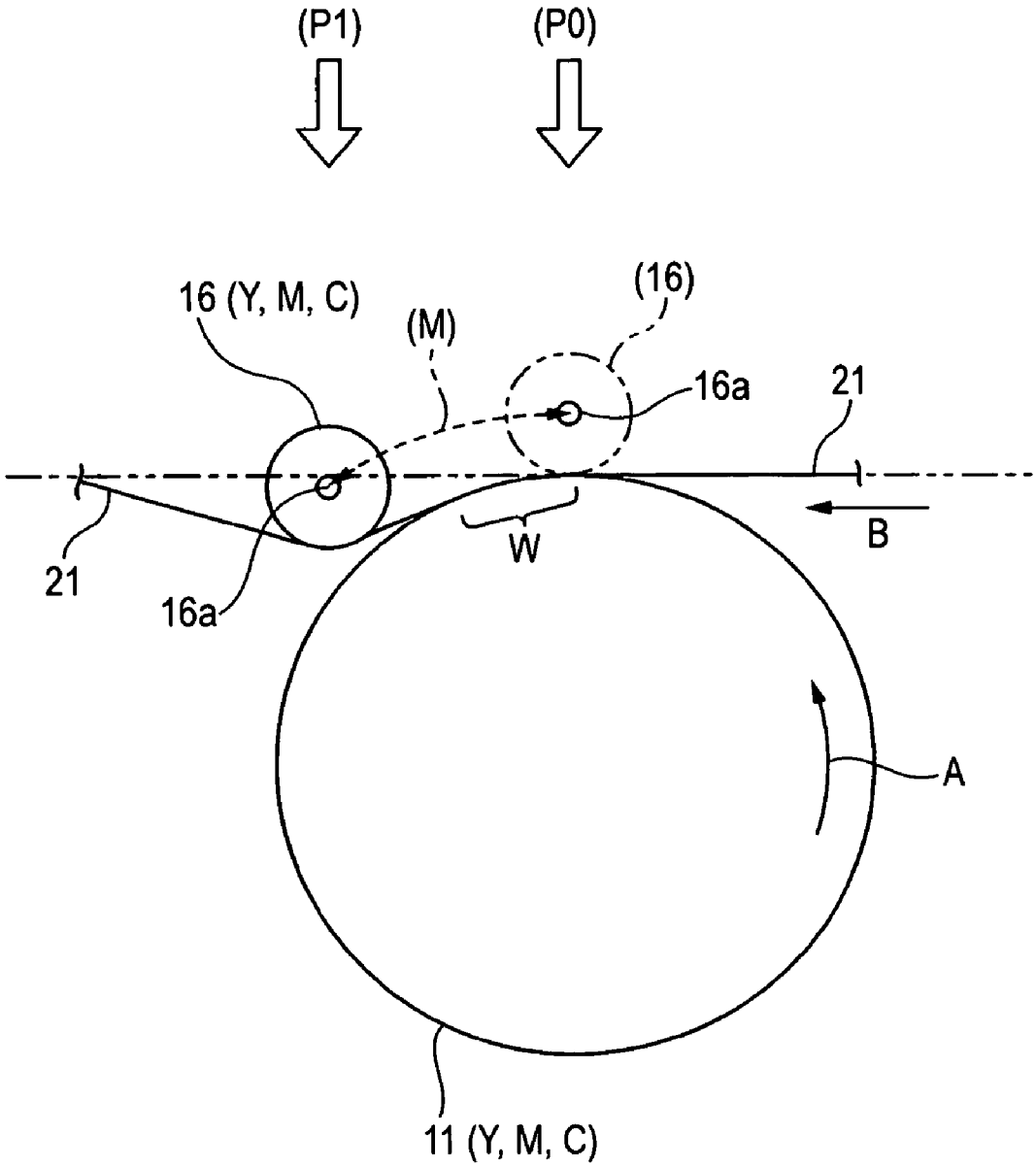
FIG. 10 is a main portion schematic explanatory view showing another example of the configuration (how to move and the state of the movement) of the moving mechanism.

The first exemplary embodiment shows by way of example the moving mechanism 6 has a configuration where an intended primary transfer roll 16 (Y, M, C) is moved from the transfer position P0 to the first position P1 through two moving steps (a first moving step E1 and a second moving step E2: see FIG. 5). As shown by the broken-like two-way arrow M in FIG. 10, the primary transfer roll 16 (Y, M, C) may be moved to the first position P1 by one moving step. In this case, for example, with reference to a concentric circle whose diameter is larger than the diameter of each photoconductor drum 11, the trajectory (M) of the moving step can be set as a trajectory composed of a curve which swells gradually to the outside of the concentric circle and out of the concentric circle as it is closer to the first position P1.

Figure 11:
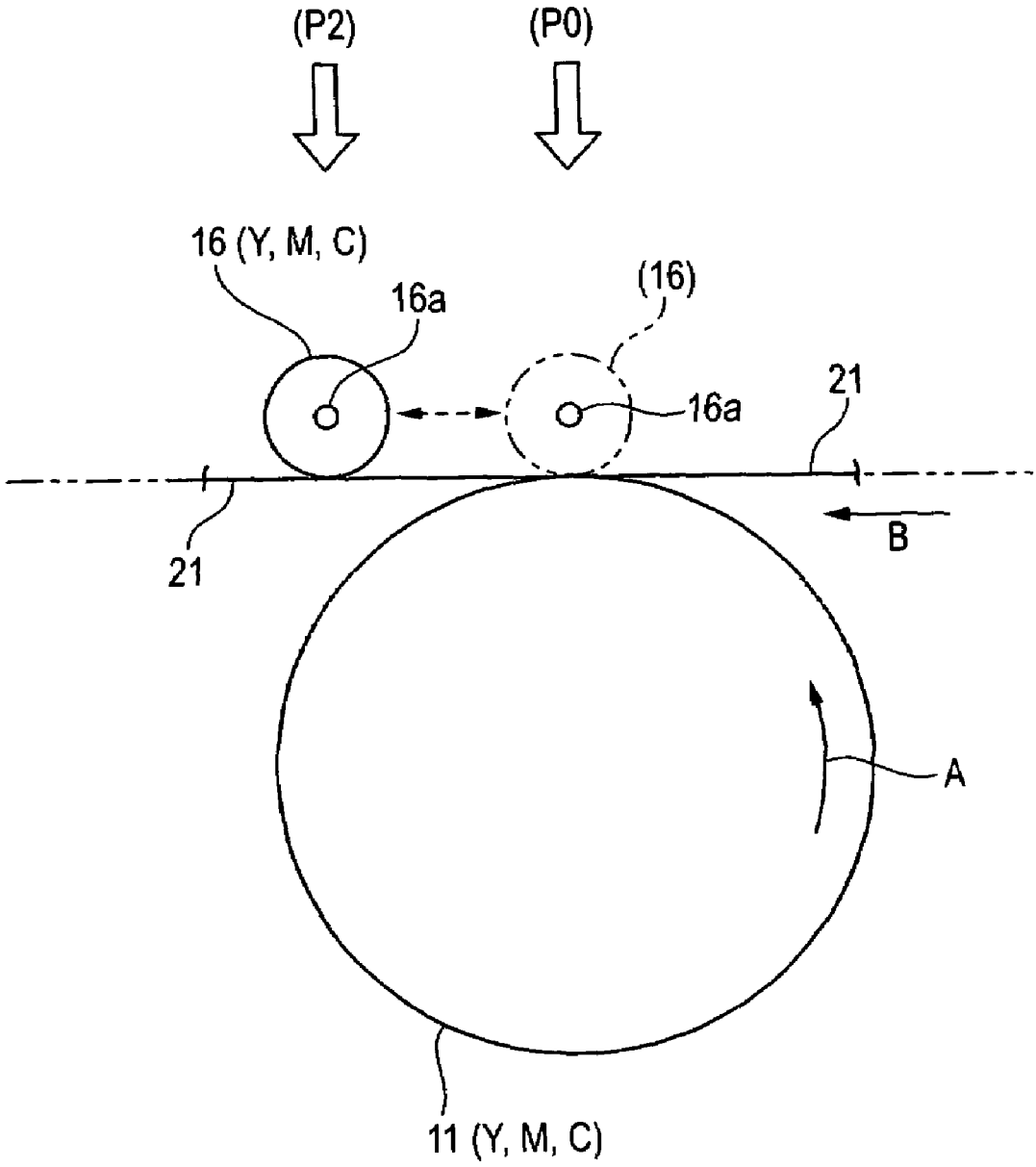
FIG. 11 is a main portion schematic explanatory view showing further another example of the configuration (how to move and the state of the movement) of the moving mechanism.

In the first exemplary embodiment, as shown in FIG. 11, the moving mechanism 6 may move each primary transfer roll 16 (Y, M, C) to a second position (P2) where the primary transfer roll 16 (Y, M, C) is kept away from the photoconductor drum 11 (Y, M, C) in the monochrome mode, while the intermediate transfer belt 21 is kept in contact with both the primary transfer roll 16 (Y, M, C) kept away from the photoconductor drum 11 (Y, M, C) and the photoconductor drum 11 (Y, M, C). In this illustrated example, as shown by the broken-like two-way arrow, the moving mechanism 6 is designed to move an intended primary transfer roll 16 in the process direction (moving direction B of the belt) by a predetermined distance. The straight line designated by the two-dot chain line in FIG. 11 designates the (virtual) state of the intermediate transfer belt 21 when the primary transfer roll 16 (Y, M, C) is located in the transfer position P0.

Figure 12:
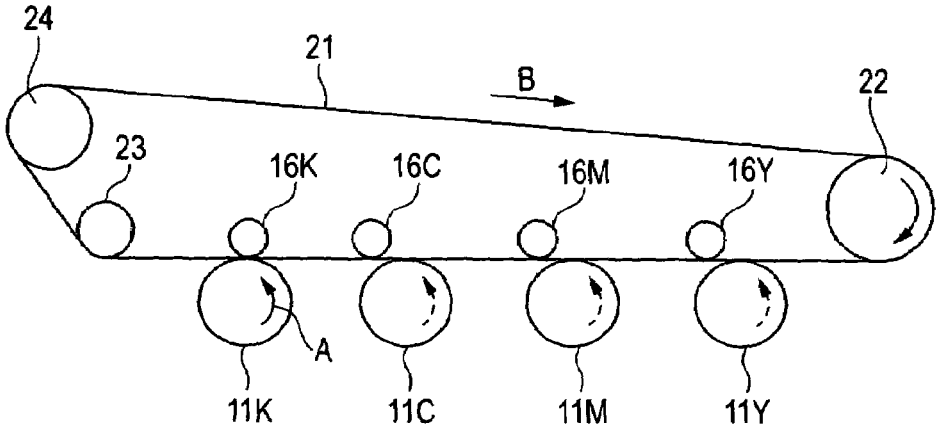
FIG. 12 is a main portion schematic explanatory view showing a state of primary transfer rolls to be moved in the monochrome mode when the moving mechanism in FIG. 11 is used.
Figure 13:
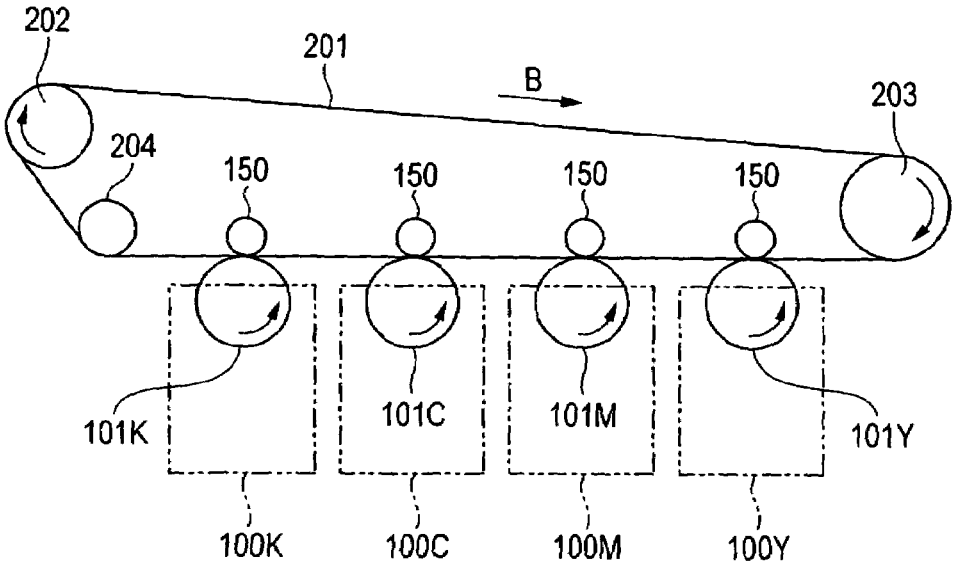
FIG. 13 RELATED ART
FIG. 13 is a schematic view showing a main portion of a background-art color image forming apparatus using an intermediate transfer system.

In this case, in the monochrome mode, the moving mechanism 6 is operated to move each color primary transfer roll 16 (Y, M, C) excluding the black primary transfer roll 16 from the transfer position P0 to the second position P2. As a result, as shown in FIG. 11 or 12, the primary transfer roll 16 (Y, M, C) leaves the photoconductor drum 11 (Y, M, C), and the intermediate transfer belt 21 is kept in contact with both each primary transfer roll 16 (Y, M, C) leaving the photoconductor drum 11 (Y, M, C) and the photoconductor drum 11 (Y, M, C).

When each color primary transfer roll 16 (Y, M, C) is moved to the second position P2 in this manner, particularly the intermediate transfer belt 21 is kept in contact with both the moved primary transfer roll 16 (Y, M, C) and the photoconductor drum 11 (Y, M, C). Thus, the intermediate transfer belt 21 is prevented from moving and running vibrating. Accordingly, in this case, even if a portion to which comparatively hard particulates or the like adhere is present in the outer circumferential surface of the intermediate transfer belt 21, the portion can be prevented from contacting the photoconductor drum 11 (Y, M, C) with pressure increased by the vibrating running. Thus, the drum surface is more hardly scratched.

In this case, the intermediate transfer belt 21 is not retained in a detour swelling on the outer circumferential surface side of the belt by the moved primary transfer rolls 16 (Y, M and C) as in the first exemplary embodiment. Accordingly, the intermediate transfer belt 21 does not contact the photoconductor drums 11 (Y, M and C) opposed to the transfer rolls due to increased tension and in a state (wrapped state) where the intermediate transfer belt 21 is wrapped around the surfaces of the photoconductor drums 11 (there is no belt portion or no wrapped portion as designated by the reference sign W in FIG. 5). Correspondingly the intermediate transfer belt 21 is prevented from strongly contacting the surfaces of the photoconductor drums 11 (Y, M and C).

The first exemplary embodiment shows the configuration in which when a black toner image is formed (in the monochrome mode), the color primary transfer rolls 16 (Y, M and C) are moved from their transfer positions P0 to their first positions P1 (or second positions P2). In a single-color print mode where a single-color toner image composed of another color (Y, M, C) is formed or in a single-color print mode where a single-color toner image composed of two other colors (two of Y, M and C) is formed, the primary transfer rolls other than the primary transfer rolls 16 to be used for the single-color mode may be moved to their first positions P1 (or second positions P2) by the moving mechanism 6. Not to say, in this case, the photoconductor drums 11 in the image forming units 10 other than the image forming units 11 to be used for the single-color mode are designed so that their rotation velocities can be changed into velocities different from that of the intermediate transfer belt 21.

The first exemplary embodiment shows by way of example an image forming apparatus in which the image forming units 10 are disposed in a lower-side running portion of the intermediate transfer belt 21. However, the present invention may be applied to an image forming apparatus in which the image forming units 10 are disposed in an upper-side running portion of the intermediate transfer belt 21. The first exemplary embodiment shows an example of a configuration in which the intermediate transfer belt 21 is disposed to be stretched horizontally as the intermediate transfer unit 20. However, the present invention can be applied to a configuration where the intermediate transfer belt 21 is disposed to be stretched vertically or in an inclined direction. Further, the number of image forming units 10 is not limited to four. The present invention may be applied to a configuration where two or three image forming units 10 are disposed, or five or more image forming units 10 are disposed by increasing the number of image forming units 10 that hold different chromatic colors other than black color.

What is claimed is:

1. An image forming apparatus comprising:

a plurality of image carriers that are disposed at intervals and in a line, and that are driven to rotate while carrying images;

an intermediate transfer belt that have an endless shape, and that is disposed to be laid on a plurality of rolls so as to be able to contact the image carriers;

a plurality of transfer rolls that rotate while being brought into contact with the image carriers through the intermediate transfer belt in a first position, respectively, so as to transfer the images on the image carriers to the intermediate transfer belt; and a moving mechanism that moves at least one of the plurality of the transfer rolls to a second position keeping apart from the plurality of the image carriers while the at least one of the plurality of the transfer rolls are kept in contact with the intermediate transfer belt, wherein the second position is on a downstream side of the first position in a direction of rotation of the intermediate transfer belt, and is nearer a center of the representative image carriers than the first position in a direction, and the direction indicates a direction perpendicular to a surface of the intermediate transfer belt when the plurality of transfer rolls is in the first position.

2. The image forming apparatus according to claim 1, wherein the moving mechanism linearly moves the at least one of the plurality of the transfer rolls from the first position to the downstream side in the direction of rotation of the intermediate transfer belt, and linearly moves the at least one of the plurality of the transfer rolls toward a center of each of the representative image carriers in the direction perpendicular to the surface of the intermediate transfer belt so as to move the at least one of the plurality of the transfer rolls to the second position.

3. The image forming apparatus according to claim 1, wherein the moving mechanism moves the at least one of the plurality of the transfer rolls from the first position to the second position along an arc.

4. The image forming apparatus according to claim 1, wherein each of the plurality of image carriers holds the image of one of black and different chromatic colors, and the at least one of the plurality of the transfer rolls corresponds to an image carrier other than an image carrier holding a toner image of black color.

5. An image forming apparatus capable of switching between a color image forming mode and a monochrome image forming mode, which comprises:

(1) an intermediate transfer section comprising:

a plurality of image carriers that are disposed at intervals and in a line, and that are driven to rotate while carrying images;

an intermediate transfer belt that have an endless shape, and that is disposed to be laid on a plurality of rolls so as to be able to contact the image carriers;

a plurality of transfer rolls that rotate while being brought into contact with the image carriers through the intermediate transfer belt in a first position, respectively, so as to transfer the images on the image carriers to the intermediate transfer belt; and a moving mechanism that moves at least one of the plurality of the transfer rolls to a second position keeping apart from the plurality of the image carriers while the at least one of the plurality of the transfer rolls are kept in contact with the intermediate transfer belt; and (2) a control section that controls the moving mechanism so as to change the rotation velocity of the at least one of the plurality of the image carriers and move the plurality of the transfer rolls corresponding to the plurality of image carriers changed in the rotation velocity from the first position to the second position, wherein the second position is on a downstream side of the first position in a direction of rotation of the intermediate transfer belt, and is nearer a center of the representative image carriers than the first position in a direction, and the direction indicates a direction perpendicular to a surface of the intermediate transfer belt when the plurality of transfer rolls is in the first position.

6. An image forming apparatus according to claim 5, wherein the control section changes the rotation velocity of the plurality of the image carriers, and moves the transfer roll corresponding to the image carrier changed in the rotation velocity when a color image forming mode is switched to a monochrome image forming mode.

* * * * *